US005785151A

United States Patent [19]

Fry et al.

[11] Patent Number: 5,785,151

[45] Date of Patent: Jul. 28, 1998

[54] COMPRESSOR WITH IMPROVED OIL PUMP AND FILTER ASSEMBLY

[75] Inventors: Emanuel D. Fry, Tecumseh; Scott L. Reiniche, North Adams, both of Mich.

[73] Assignee: Tecumseh Products Company, Tecumseh, Mich.

[21] Appl. No.: 749,471

[22] Filed: Nov. 15, 1996

[51] Int. Cl.[6] ..... F04C 29/02

[52] U.S. Cl. ..... 184/6.16; 184/6.18; 184/6.24; 418/89; 418/94; 418/151

[58] Field of Search ..... 184/6.16, 6.18, 184/6.24; 418/89, 94, 151; 411/121, 122, 123, 533

[56] References Cited

U.S. PATENT DOCUMENTS

| | | | |
|---|---|---|---|
| 1,526,450 | 2/1925 | Wishart . | |
| 2,038,131 | 4/1936 | Richard . | |
| 2,200,222 | 5/1940 | Tarleton . | |
| 2,844,302 | 7/1958 | Weibel, Jr. . | |
| 2,996,240 | 8/1961 | Stocklein et al. . | |
| 3,169,696 | 2/1965 | Warner . | |
| 3,248,044 | 4/1966 | Parker . | |
| 3,250,461 | 5/1966 | Parker . | |
| 3,317,123 | 5/1967 | Funke . | |
| 3,454,213 | 7/1969 | Valbjorn . | |
| 3,659,674 | 5/1972 | Ferrario . | |
| 3,664,461 | 5/1972 | Leffers et al. . | |
| 4,097,185 | 6/1978 | Wolf . | |
| 4,459,208 | 7/1984 | Lemon . | |
| 4,478,559 | 10/1984 | Andrione et al. . | |
| 4,560,329 | 12/1985 | Hirahara et al. . | |
| 4,614,123 | 9/1986 | Thompkins . | |
| 4,724,928 | 2/1988 | Lewis et al. . | |
| 4,738,600 | 4/1988 | Safford . | |
| 4,787,971 | 11/1988 | Lambousy et al. | 411/122 |
| 4,877,382 | 10/1989 | Caillat et al. . | |
| 4,969,804 | 11/1990 | Gannaway . | |
| 5,007,807 | 4/1991 | Gannaway . | |
| 5,131,828 | 7/1992 | Richardson, Jr. et al. . | |
| 5,176,506 | 1/1993 | Siebel . | |
| 5,232,351 | 8/1993 | Robertson et al. . | |
| 5,372,490 | 12/1994 | Fain . | |

FOREIGN PATENT DOCUMENTS

| | | | |
|---|---|---|---|
| 0510681 | 3/1955 | Canada | 411/123 |

*Primary Examiner*—Christopher Verdier
*Attorney, Agent, or Firm*—Baker & Daniels

[57] ABSTRACT

A compressor having an oil pick-up tube which filters incoming lubricant, and increases the volumetric pumping capacity of the compressor. The oil pick-up tube is attached to the crankshaft of the compressor, and is partially disposed within an oil sump also provided in the compressor. When the motor of the compressor is energized, the crankshaft and the oil pick-up tube rotate, and oil from the oil sump is drawn into the oil pick-up tube. A passageway is provided within the motor shaft to communicate oil from the oil pick-up tube to the compressor mechanism of the compressor for lubrication purposes. A cylindrical screen is also provided within the oil pick-up tube to both filter the incoming oil and provide a surface to which the oil adheres as it migrates upward through the rotating tube and expels the oil radially outward to increase the velocity of the migrating oil. The volumetric pumping capacity of the compressor is thereby increased. A pitot tube is provided at the top of the axial oil passageway to create an additional vacuum within the axial oil passageway and thus increase the volumetric pumping capacity of the compressor.

15 Claims, 4 Drawing Sheets

COMPRESSOR WITH IMPROVED OIL PUMP AND FILTER ASSEMBLY

BACKGROUND OF THE INVENTION

1. Field of the Invention

The present invention generally relates to oil pumps, and more particularly, relates to centrifugal oil pumps used in refrigeration compressors.

2. Description of the Related Art

A centrifugal oil pump typically includes a hollow tube which extends from an oil sump to the area which is to receive the pumped oil. As the hollow tube rotates, centrifugal force tends to draw the oil into the tube and radially outward toward the inner circumference of the hollow tube. As oil continues to be drawn into the tube, lift is created which tends to force the oil up the hollow tube and eventually to the area which receives the pumped oil.

Such oil pumps are often used in compressors wherein the hollow tube is an oil pick-up tube disposed at the end of a motor shaft within the compressor. The oil pick-up tube draws oil in from an oil sump and the oil then migrates up a passageway within the motor shaft and to the compressor section for lubrication thereof. Such a system is disclosed in U.S. Pat. No. 5,232,351, assigned to the present assignee, the disclosure of which is expressly incorporated by reference herein.

Since the oil within the oil sump is recycled through the compressor, any particulates which are released into the oil, will be pumped along with the recycled oil. If the particulates are large or abrasive, they can damage the moving parts of the compressor section such as the pistons, valves, and scrolls. Moreover, given the lubrication demands of the compressor, along with the machining tolerances of the compressor, such a centrifugal oil pump may not be able to pump a sufficient volume of oil to provide proper lubrication.

Prior art devices, such as that disclosed in U.S. Pat. No. 2,200,222, issued to Tarleton, disclose the use of a screen at the mouth of an oil pick-up tube of a compressor, but such a device does not increase the pumping capacity of the oil pick-up tube.

U.S. Pat. No. 5,372,490 discloses a compressor having a screen disposed in the oil tube, and rotating therewith. The rotating oil tube has an impeller which swirls the oil to thereby form a vortex forcing a portion of the oil through the screen. This motion filters the oil and removes particulates which might damage the compressor. However, the overall pumping capacity of the oil pick-up tube is not improved.

SUMMARY OF THE INVENTION

The present invention provides a refrigerant compressor having an oil pump which satisfies the above-identified needs by providing a mechanism which filters the oil as it is pumped, and which increases the overall pumping capacity of the oil pump and compressor.

In the exemplary embodiment, the present invention is a refrigerant compressor having a compressor mechanism and a motor wherein the crankshaft drives the compressor mechanism. The end of the crankshaft includes an oil pick-up tube which is disposed in an oil sump and which draws oil from the sump, through the motor shaft, and into the compressor mechanism for lubrication purposes.

The oil pick-up tube of the present invention includes a cylindrical screen disposed about the inner circumference of the oil pick-up tube which both filters the pumped oil, and increases the pumping capacity of the compressor. As the oil enters the inlet of the oil pick-up tube, and the oil pick-up tube is rotating at the speed of the motor shaft, centrifugal force tends to force the oil towards the inner circumference of the oil pick-up tube where it is engaged by the cylindrical screen.

Given the shape and surface area of the cylindrical screen, the oil adheres to the screen and migrates upward to an enlarged diameter section of the oil pick-up tube. The oil is then expelled radially outward from the screen to the inner circumference of the enlarged diameter section of the oil pick-up tube. Because the screen is rotating at shaft velocity, the oil gains velocity as it goes through the screen and is pumped through the oil pick-up tube toward the compressor mechanism with increased velocity. The refrigerant compressor therefore can pump a larger volume of oil than oil pick-up tubes without such screens, and the refrigerant compressor also is provided with filtered oil substantially free of particulates and foreign matter contained within the oil sump.

One advantage of the present invention is that the oil pumped through the refrigerant compressor is filtered and is therefore substantially free of particulates and foreign matter.

Another advantage of the present invention is that it increases the volumetric pumping capacity of the oil pick-up tube and the compressor.

The present invention provides, in one form thereof, a compressor comprising a housing, a compressor mechanism, a motor, an oil pick-up tube, and a screen. The compressor mechanism and the motor are disposed within the housing. The motor drives the crankshaft of the compressor mechanism, with the crankshaft including an axial passageway. The axial passageway has an upper end and a lower end and is in fluid communication with the compressor mechanism. The oil pick-up tube is connected to the crankshaft for rotation therewith and extends into an oil sump provided within the housing. The oil pick-up tube includes a lower reduced diameter section, and an upper enlarged diameter section, with oil from the sump being drawn into an inlet provided in the reduced diameter section when the crankshaft rotates. The screen is cylindrical and is disposed within the oil pick-up tube. An annular space is formed between the cylindrical screen and the enlarged diameter section. Rotation of the crankshaft and screen causes oil from the sump to migrate up the screen through the reduced diameter section. The oil is then expelled from the screen radially outward to the enlarged diameter section and upward to the axial passageway and compressor mechanism. Since the inlet to the oil pick-up tube is submerged in the oil sump, the expelled oil is forced to flow upward toward the compressor section.

BRIEF DESCRIPTION OF THE DRAWINGS

The above mentioned and other features and advantages of this invention, and the manner of attaining them, will become more apparent and the invention will be better understood by reference to the following description of an embodiment of the invention taken in conjunction with the accompanying drawings wherein.

Corresponding reference characters indicate corresponding parts throughout the several views. The exemplification set out herein illustrates one embodiment of the invention, and such exemplification is not to be construed as limiting the scope of the invention in any manner.

DETAILED DESCRIPTION OF THE INVENTION

Figure 1:
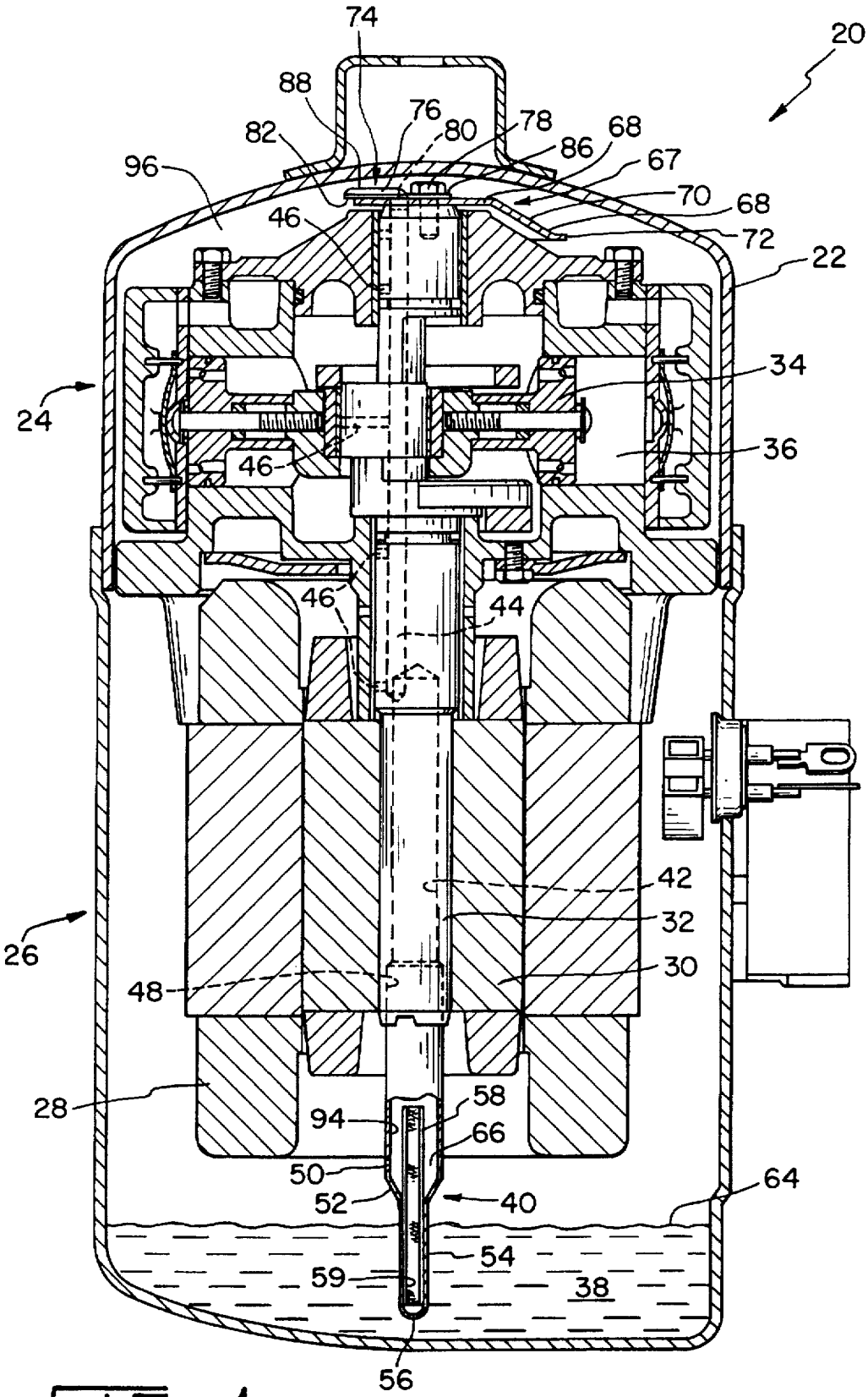
FIG. 1 is a longitudinal sectional view of the present invention.

Referring now to FIG. 1, compressor 20 is shown having housing 22. Although a compressor having reciprocating pistons is shown in FIG. 1, it is to be understood that the present invention also encompasses other types of compressors including rotary and scroll compressors. Compressor mechanism 24 and motor 26 are shown disposed within housing 22, wherein motor 26 includes stator 28 and rotor 30. Crankshaft 32 is frictionally held within rotor 30 and extends to compressor mechanism 24 to drive pistons 34 within cylinders 36. Oil sump 38 is provided at the base of compressor 20.

Oil pick-up tube 40 is partially disposed within oil sump 38 to draw oil from sump 38 into axial oil passageway 42 of crankshaft 32, and up through offset oil passageway 44. A plurality of radial passageways 46, are provided to communicate lubricating oil from sump 38 to the various moving parts of compressor 20 including pistons 34 within cylinders 36.

Figure 2:
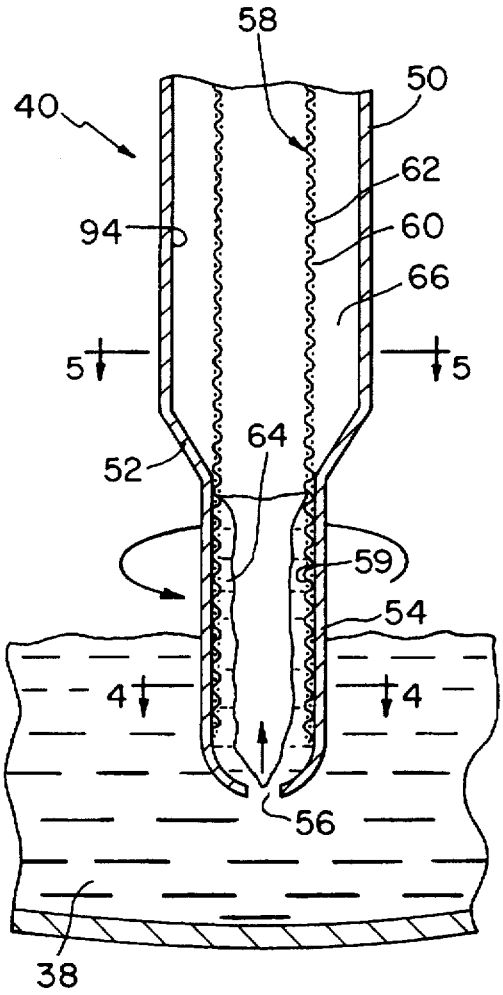
FIG. 2 is a enlarged fragmentary sectional view of the oil pick-up tube shown in FIG. 1.

Crankshaft 32 includes counter bore 48 to provide a recess into which oil pick-up tube 40 is disposed. As best shown in FIG. 2, oil pick-up tube 40 includes enlarged diameter section 50, tapered section 52, and reduced diameter section 54. Reduced diameter section 54 includes inlet 56 at its base.

Figure 4:
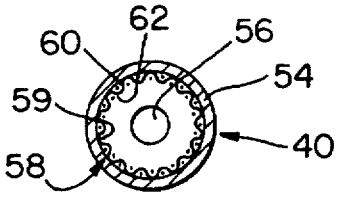
FIG. 4 is a sectional view of the oil pick-up tube taken along line 4—4 of FIG. 2.
Figure 5:
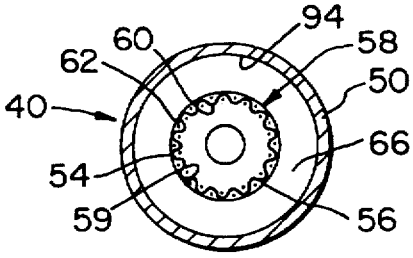
FIG. 5 is a sectional view of the oil pick-up tube taken along line 5—5 of FIG. 2.

Screen 58, having a cylindrical shape as best shown in FIGS. 4 and 5, is disposed within oil pick-up tube 40 in engagement with inner circumference 59 of reduced diameter section 54. As best shown in FIG. 4, reduced diameter section 54 and cylindrical screen 58 have substantially similar diameters.

Figure 3:
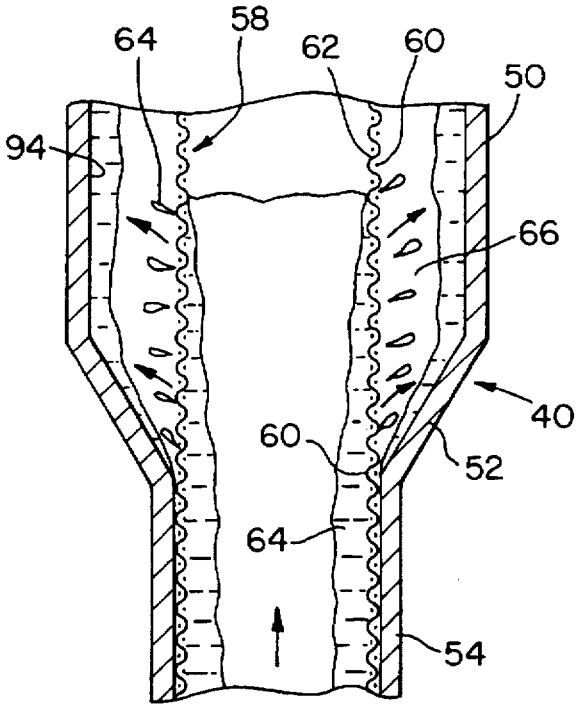
FIG. 3 an enlarged fragmentary sectional view of the portion of the oil pick-up tube showing the enlarged diameter section and the screen disposed therein.

Screen 58 is a conventional mesh screen comprised of a plurality of wires 60 arranged in grid formation and is disposed in reduced diameter section 54 of oil pick up tube 40, and is at least partially disposed in enlarged diameter section 50 of oil pick-up tube 40, as shown in FIG 1. In the preferred embodiment, screen 58 is made of stainless steel and includes a 100×90 mesh having 0.0043–0.0045 apertures therein. This is also referred to as a stainless steel wire cloth. Screen 58 therefore includes a plurality of apertures 62 formed between crossing wires 60. Apertures 62 provide additional surface area to which oil 64 adheres as it migrates upward, and also provide a rotating surface from which oil 64 is propelled. As best shown in FIG. 3, oil 64 is propelled across annular space 66 and engages tapered section 52.

Apertures 62 also perform a filtering function in that apertures 62 are of a small enough cross-sectional area to prevent particulates and other foreign matter contained within oil sump 36 from entering oil pick-up tube 40 and thus prevent such particulates from entering compressor mechanism 24 and damaging the moving parts contained therein.

Figure 6:
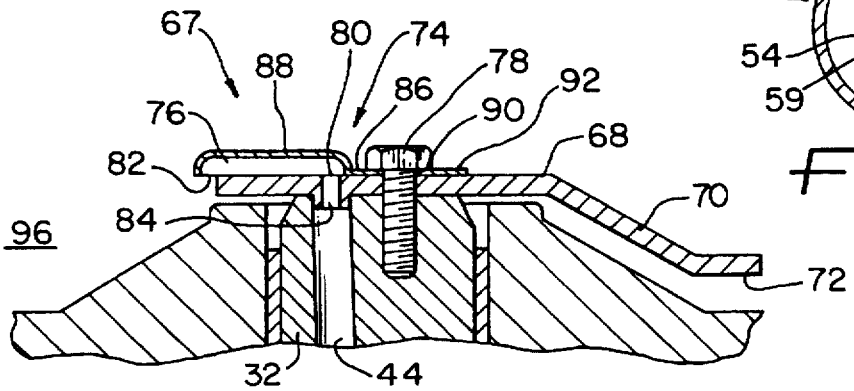
FIG. 6 is a enlarged fragmentary sectional view of the counterweight, pitot tube, crankshaft, and a portion of the compressor mechanism.

As best shown in FIG. 6, counterweight assembly 67 is disposed at the top of compressor section 24 and includes planar member 68 with integral angled arm 70 and lip 72, and pitot plate 74. Pitot plate 74 is shaped to form pitot tube or passage 76 when secured to planar member 68 using bolt 78. Pitot passage 76 includes an inlet 80 and outlet 82. Planar member 68 includes offset aperture 84 so that when pitot plate 74 is secured to planar member 68, pitot passage inlet 80 is placed in communication with offset oil passageway 44.

Figure 7:
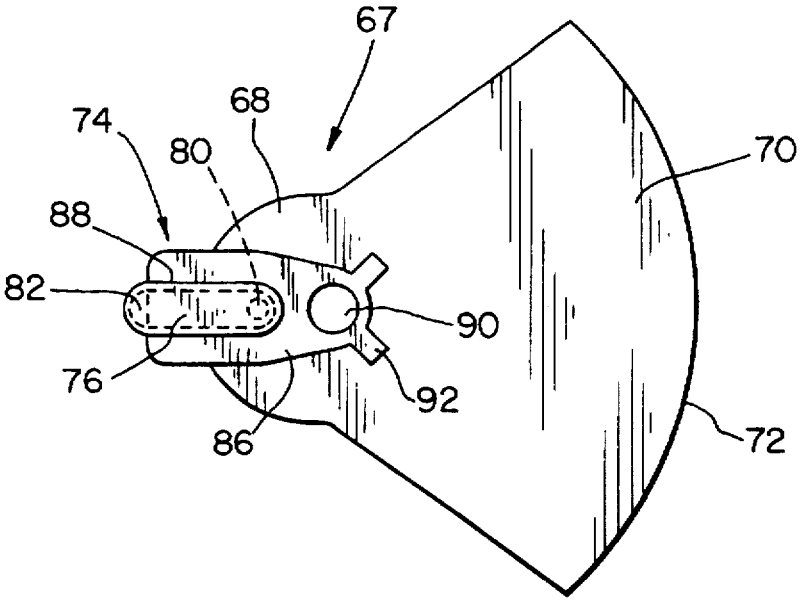
FIG. 7 is a plan view of the counterweight shown in FIG. 6.

Referring now to FIG. 7, pitot plate 74 is shown having base 86, recessed portion 88, aperture 90, and locking tabs 92. Recessed portion 88 forms pitot passage 76 when plate 74 is secured to planar member 68. Aperture 90 allows bolt 78 to pass therethrough for fastening plate 74 to shaft 32. Locking tabs 92 are plastically deformable and are adapted to be bent around the head of bolt 78 to thereby lock pitot plate 74 into correct rotational orientation relative to planar member 68. Although FIG. 7 shows two locking tabs 92, one such tab or more than two such tabs may be used to perform this function.

In operation, oil pick-up tube 40 is disposed within oil sump 38. As crankshaft 32 rotates in the direction shown in FIG. 2, oil 64 is drawn in through inlet 56 of reduced diameter section 54, passes through screen 58, and migrates upward by centrifugal force along the interior wall of tube 54. Screen 58 increases the tangential velocity of oil 64 to thereby increase the rotational velocity and centrifugal force thereon.

As shown in FIG. 3, when oil 64 reaches tapered section 52, oil 64 is expelled in a radial direction across annular space 66. The angle of tapered section 52 directs oil 64 upward. As shaft 32 continues to rotate, centrifugal force continues to draw oil 64 upward and the increased velocity of oil 64, attained by screen 58 expelling oil 64 across annular space 66 to inner circumference 94 of enlarged diameter section 50, pushes oil 64 up through oil pick-up tube 40 and into axial oil passageway 42 of shaft 32.

As pitot plate 74 rotates, pitot passage outlet 82 rotates past a standing body of refrigerant contained within chamber 96. This motion induces a vacuum within pitot passage 76 which, in turn, induces a vacuum within, and provides increased pumping capacity through, offset oil passageway 44, axial oil passageway 42, and oil pick-up tube 40. The volume of oil 64 pumped through compressor 20 is thereby increased.

Figure 8:
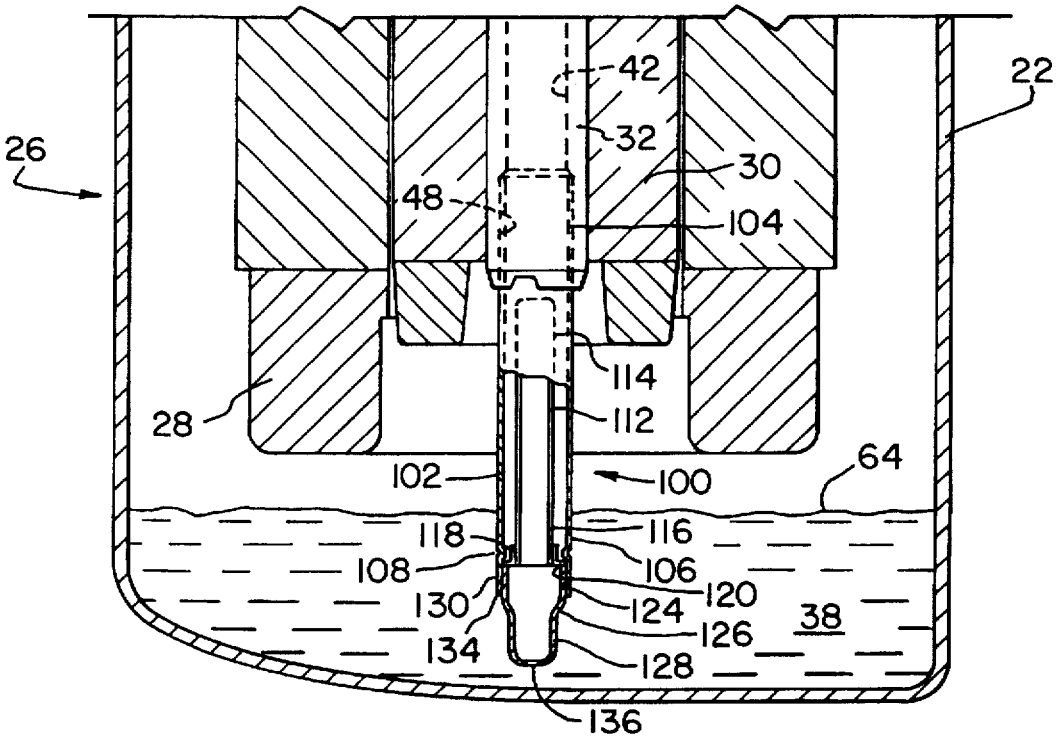
FIG. 8 is a partial sectional view of a second embodiment of the present invention oil pick-up tube incorporated in the refrigeration compressor of FIG. 1.
Figure 9:
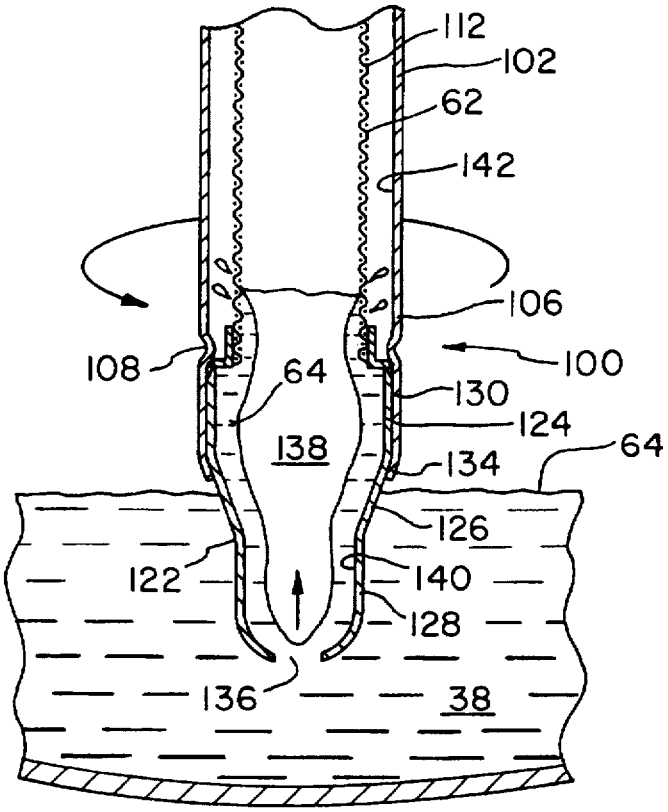
FIG. 9 is a fragmentary sectional view of the oil pick-up tube of FIG. 8.
Figure 10:
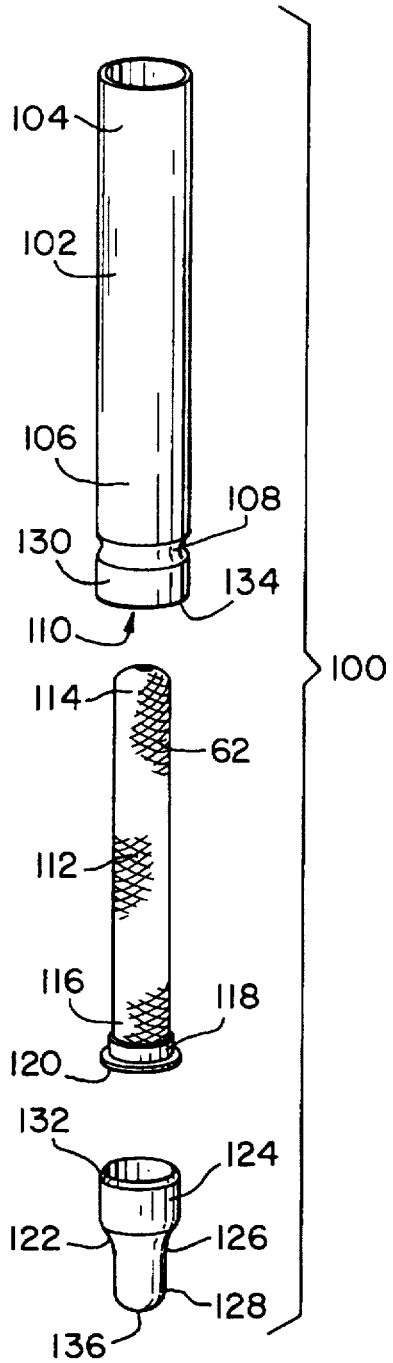
FIG. 10 is an exploded perspective view of the oil pick-up tube assembly of FIG. 8.

A preferred embodiment of the oil pick-up tube assembly of the present invention is illustrated in FIGS. 8–10, wherein the oil pick-up tube assembly, referenced generally at 100, is partially disposed within oil sump 38 to draw oil from sump 38 into axial oil passageway 42 of crankshaft 32, and up through offset oil passageway 44 as described hereinabove with respect to oil pick-up tube 40. Oil pick-up assembly 100 includes tubular body 102 having an upper portion 104 which is received into counterbore 48 of crankshaft 32. Lower portion 106 of tubular body 102 is provided with an inwardly extending annular protuberance 108 and an opening 110.

Tubular stainless steel wire cloth mesh screen 112 is axially upwardly disposed in tubular body 102 through opening 110. Screen 112 includes upper end 114, which is preferably square folded and spot welded, and lower end portion 116 and a stainless or tin plated end collar 118. Collar 118 is provided with an outwardly extending lip 120 having an outer diameter which is larger than the outer diameter of screen 112. Annular protuberance 108 is provided with an inner diameter which is smaller than the inner diameter of lip 120. With screen 112 disposed in tubular body 102, protuberance 108 acts as an axial stop and engages lip 120 to prevent further movement of screen 112 in the upward direction.

Oil pick-up tube extension 122 has an upper portion 124, a tapered middle portion 126 and a lower portion 128. The outer diameter of upper portion 124 is approximately the same as or slightly larger than the inner diameter of receiving end 130 of tubular body 102. End 132 of tube extension 122 is tapered so that end 132 is capable of being received through opening 110 and into receiving end 130 of tubular body 102. With screen 112 disposed in tubular body 102 such that lip 120 engages stop protuberance 108, extension 122 is forcibly pushed axially upwards into receiving end 130. If the inner diameter of receiving end 130 is smaller than the outer diameter of upper portion 124, then receiving end 130 will forcibly deflect in the radial direction so as to expand sufficiently to receive upper portion 124 of extension 122. With upper portion 124 disposed in receiving end 130, end 132 is adjacent and abuts lip 120 which is thereby sandwiched between stop protuberance 108 and end 132 and is thereby securely held in place within tubular body 102. With extension 122 received in tubular body 102, lower end 134 of tubular body 102 is crimped to conform to the shape of tapered middle portion 126 of extension 122. Once crimped, the inner diameter of end 134 is smaller than the outer diameter of upper portion 124. In this manner, oil pick-up tube extension 122 is fixably attached to tubular body 102. Lower portion 128 of tube extension 122 is provided with opening 136 which with tube extension 122 submerged in oil sump 38 receives oil into the hollow interior 138 of oil pick-up tube assembly 100 as shown in FIG. 9.

During compressor operation, with oil pick-up tube assembly 100 attached to crankshaft 32, and partially submerged in oil sump 38, opening 136 is in communication with oil in sump 38. As crankshaft 32 rotates, a low pressure condition occurs at opening 136 causing oil 64 to be urged upward in oil pick-up tube assembly 100 at opening 136. Centrifugal force acts upon the oil in the pick-up tube assembly causing the oil to migrate axially upwards along inner surface 140 of extension 122 to screen 112. The oil passes through screen 58 via apertures 62 and is forced radially outward to inner surface 142 of tubular body 102. Screen 112 increases the tangential velocity of oil 64 to thereby increase the rotational velocity and centrifugual force thereon. As shaft 32 continues to rotate, centrifugal force continues to act on oil 64 and the increased velocity of oil 64 causes oil 64 to migrate upward through tubular body 102 and into axial oil passageway 42 of shaft 32. As described above, oil continues to migrate upward through offset oil passageway 44 and radially outward through radial passageways 46 to communicate lubricating oil from sump 38 to the various moving parts of compressor 20. As described above, the vacuum induced within pitot passage 76 caused by rotating pitot passage outlet 82 across a standing body of refrigerant contained within chamber 96, increases the pumping capacity of the lubrication pumping apparatus. The increased pumping capacity, through offset oil passageway 44, axial oil passageway 42 and oil pick-up tube 40, increases the volume of oil pumped through compressor 20. Examples of particular lubrication systems used in refrigeration compressors are described in more detail in U.S. Pat. No. 5,232,351 (Robertson, et al.), relating to a lubrication system used in a reciprocating type compressor, and U.S. Pat. No. 5,131,828 (Richardson, Jr. et al.), relating to a lubrication system in a scroll compressor. The referenced patents are assigned to the assignee of the present invention and are hereby incorporated into this document by reference.

While this invention has been described as having a particular design, the present invention can be further modified within the spirit and scope of this disclosure. This application is therefore intended to cover any variations, uses, or adaptations of the invention using its general principals. Further, this application is intended to cover such departures from the present disclosure as come within known or customary practice in the art to which this invention pertains, and which fall within the limits of the appended claims.

What is claimed is:

1. A compressor, comprising:

an outer housing;

a compressor mechanism disposed within said housing and having a crankshaft;

a motor disposed within said housing and driving said crankshaft, said crankshaft including an axial passageway having an upper end and a lower end, said axial passageway in fluid communication with said compressor mechanism;

an oil pick-up tube connected to said crankshaft for rotation therewith and extending into an oil sump provided within said housing, said pick-up tube including a lower reduced diameter section and an upper enlarged diameter section, oil from said sump being drawn into an inlet provided in said reduced diameter section when said crankshaft rotates; and a cylindrical screen disposed within said lower reduced diameter section and at least a portion of said upper enlarged diameter section of said oil pick-up tube, an annular space formed between said cylindrical screen and said enlarged diameter section, rotation of said crankshaft and screen causing the oil from said sump to migrate up said screen through said reduced diameter section, the oil being expelled from said screen radially outward to said enlarged diameter section and upward to said axial passageway and said compressor mechanism, whereby the pumping capability of said oil pick-up tube is enhanced.

2. The compressor of claim 1, further including a pitot tube disposed at said upper end of said axial passageway, said pitot tube being disposed radially from said axial passageway and including an inlet and an outlet, said inlet being in communication with said axial passageway, said outlet rotating past a standing body of air within said housing when said shaft rotates, the motion of said pitot tube outlet past said standing body of air creating a vacuum within said pitot tube and said axial passageway which assists in drawing oil from said sump to said compressor mechanism through said axial passageway.

3. The compressor of claim 2, wherein said compressor further includes a counterweight assembly with said pitot tube formed therein, said counterweight assembly including a counterweight member and a plate member, said plate member including a base and a recessed portion, said recessed portion and said counterweight member forming said pitot tube when said counterweight member and said plate member are secured together.

4. The compressor of claim 3, wherein said plate member includes an aperture therethrough and at least one locking tab, said plate member being secured to said counterweight member and said crankshaft by a fastener, said fastener passing through said at least one locking tab adapted to bend around said fastener to maintain said plate member in proper rotational position relative to said counterweight member.

5. The compressor of claim 1, wherein said screen includes a plurality of wires forming a grid with a plurality of openings between said wires, said openings having sufficiently small cross-sectional areas to effectively filter oil from said sump to thereby prevent particulates contained within said sump from reaching and damaging said compressor mechanism.

6. The compressor of claim 1, wherein said oil pick-up tube further includes a tapered section between said lower, reduced diameter section and said upper, enlarged diameter section, said tapered section directing said oil expelled from said screen to flow upward toward said enlarged diameter section and said axial passageway.

7. The compressor of claim 1, wherein said cylindrical screen is in concentric engagement with the inner circumference of said reduced diameter section of said oil pickup tube, said screen providing increased surface area to which the oil adheres as the oil migrates up said oil pick-up tube, the flow rate of oil through said compressor thereby being increased.

8. A compressor, comprising:

a housing;

a compressor mechanism disposed within said housing and having a crankshaft;

a motor disposed within said housing and driving said crankshaft, said crankshaft including an axial passageway having an upper end and a lower end, said axial passageway in fluid communication with said compressor mechanism;

an oil pick-up tube having an upper enlarged diameter end connected to said crankshaft for rotation therewith and a lower reduced diameter end extending into an oil sump provided within said housing, said upper end being in fluid communication with said axial oil passageway and said lower end having an opening receiving oil from said sump when said crankshaft rotates; and a cylindrical screen disposed within said oil pick-up tube, an annular space formed between said cylindrical screen and said upper enlarged diameter end of said oil pick-up tube, whereby the rotation of said crankshaft and said screen causes oil from said sump to migrate up said screen, the oil being expelled from said screen radially outward to said inner surface and upward to said axial passageway and said compressor mechanism, whereby the pumping capability of said oil pick-up tube is enhanced.

9. The compressor of claim 8, further including a pitot tube disposed at said upper end of said axial passageway, said pitot tube being disposed radially from said axial passageway and including an inlet and an outlet, said inlet being in communication with said axial passageway, said outlet rotating past a standing body of air within said housing when said shaft rotates, the motion of said pitot tube outlet past said standing body of air creating a vacuum within said pitot tube and said axial passageway which assists in drawing oil from said sump to said compressor mechanism through said axial passageway.

10. The compressor of claim 9, wherein said compressor further includes a counterweight assembly with said pitot tube formed therein, said counterweight assembly including a counterweight member and a plate member, said plate member including a base and a recessed portion, said recessed portion and said counterweight member forming said pitot tube when said counterweight member and said plate member are secured together.

11. The compressor of claim 10, wherein said plate member includes an aperture therethrough and at least one locking tab, said plate member being secured to said counterweight member and said crankshaft by a fastener, said fastener passing through said at least one locking tab adapted to bend around said fastener to maintain said plate member in proper rotational position relative to said counterweight member.

12. The compressor of claim 8, wherein said screen includes a plurality of wires forming a grid with a plurality of openings between said wires, said openings having sufficiently small cross-sectional areas to effectively filter oil from said sump to thereby prevent particulates contained within said sump from reaching and damaging said compressor mechanism.

13. The compressor of claim 8, wherein said oil pick-up tube comprises a tubular body and an oil pick-up extension, said tubular body is connected to said crankshaft at said upper end, said oil pick-up extension extends into said oil sump at said lower end, and said tubular body is connected to said oil pick-up extension intermediate said upper end and said lower end.

14. The compressor of claim 13, wherein said oil pick-up extension includes a middle section which tapers from a smaller diameter at a point proximate said lower end to a larger diameter at a point distal said lower end, said tapered middle section directing the oil from said sump to flow upward toward said axial passageway.

15. The compressor of claim 8, wherein said cylindrical screen is in concentric relationship with the inner circumference of said oil pick-up tube, said screen providing increased surface area to which the oil adheres as the oil migrates up said oil pick-up tube, the flow rate of oil through said compressor thereby being increased.

* * * * *

UNITED STATES PATENT AND TRADEMARK OFFICE

CERTIFICATE OF CORRECTION

PATENT NO. : 5,785,151

DATED : July 28, 1998

INVENTOR(S) : Emanuel D. Fry, et al.

It is certified that error appears in the above-identified patent and that said Letters Patent is hereby corrected as shown below:

Claim 4, Col. 7, Line 9 After "through" insert --said aperture,--.

Claim 11, col.8, line 26, After "through" insert --said aperture,--.

Signed and Sealed this

Twenty-fourth Day of November,1998

*Attest:*

Bruce Lehman

BRUCE LEHMAN

*Attesting Officer*

*Commissioner of Patents and Trademarks*